United States Patent [19]

Goleczka et al.

[11] Patent Number: 4,787,913

[45] Date of Patent: Nov. 29, 1988

[54] COAL BRIQUETTING PROCESS

[75] Inventors: Joseph Goleczka, Cheltenham; Walter Harris; Stephen Sawyer, both of Tewkesbury; Simon Kelly, Cheltenham, all of England

[73] Assignee: Coal Industry (Patents) Limited, United Kingdom

[21] Appl. No.: 164,913

[22] Filed: Mar. 7, 1988

[30] Foreign Application Priority Data

Mar. 26, 1987 [GB] United Kingdom ..... 8707223

[51] Int. Cl.[4] ..... C10L 5/12; C10L 5/14

[52] U.S. Cl. ..... 44/16 R; 44/15 R; 44/599

[58] Field of Search ..... 44/15 R, 16 R, 26, 599

[56] References Cited

U.S. PATENT DOCUMENTS

| | | | |
|---|---|---|---|
| 2,110,370 | 3/1938 | Lum | 44/16 R |
| 3,213,169 | 10/1965 | Kardaun et al. | 44/15 R |
| 4,156,595 | 5/1979 | Scott et al. | 44/15 R |

FOREIGN PATENT DOCUMENTS

| | | | |
|---|---|---|---|
| 3445503 | 6/1986 | Fed. Rep. of Germany | 44/26 |
| 229905 | 5/1925 | United Kingdom | 44/16 R |

*Primary Examiner*—Carl F. Dees

*Attorney, Agent, or Firm*—Stevens, Davis, Miller & Mosher

[57] ABSTRACT

A cold coal briquetting process comprises mixing fine coal with polyvinyl alcohol and a hardening agent selected from iron oxide, phosphate rock and bauxite or combination of two or more thereof. The process permits economies in process and capital costs compared to existing briqueting processes, while still producing satisfactory briquettes.

7 Claims, No Drawings

COAL BRIQUETTING PROCESS

This invention concerns a coal briquetting process, and more especially it concerns a process for "cold" briquetting.

There exist many processes for briquetting fine coals in which the mixture fed to the briquetting press is hot, and various binders which melt at the operating temperatue, such as pitch are used. In some cases, the coal itself, because it cakes during heating to temperature, forms or contributes to the binder. There is also interest in "cold" coal briquetting processes which require no heating or only heating to about 100° C. before briquetting without subsequent heating to a higher temperature. A binder must be used, therefore, which is effective at low temperatures, and many binders have been suggested. A problem faced especially by "cold" briquetting processes, is that the binders in the product briquetttes may not provide adequate binding of the fine coal at or near the combustion temperature, resulting in partial or complete disintegration of the briquette and the loss of coal through the grate. This is termed "undergrate loss".

It is an aim of the present invention to provide a cold coal briquetting process producing briquettes which have adequate strength, which do not show excessive undergrate losses and utilizing an inexpensive binder system which is tolerant of variations in the quantities of components and is not hazardous. Desirably, the briquettes exhibit good water resistance to prevent degradation during open air stocking.

Binders which have been suggested for cold briquetting processes include bitumen, starch and resin combinations, binders based on polyvinyl alcohol, e.g. PVA/-calcium oxide (see GBP2138442), PA/molasses (Europatent 0135784), PA/calcium oxide (see GBP2138442), PVA/molasses (Europatent 0135784), PVA/calcium carbonate (Europatent 0135785), molasses and lime, molasses and phosphoric acid (GBP 230306) and binders based on sulphite lye, eg. sulphite lye, solium dichromate and sulphuric acid (Europatent 0127351). We have tested most and considered all of the above processes and their product briquettes, and we consider that most exhibit problems mitigating against large scale use and acceptability.

There remains a need in the market for fuel briquettes having acceptable burning and strength qualities, despite the many different types of smokeless and non-smokeless briquettes commercially available. The better smokeless briquettes, for example, are relatively expensive or limited in availability. It is an aim of the present invention to provide such fuel briquettes by a process which is relatively inexpensive in capital and running costs.

The present invention provides a briquetting process comprising mixing fine coal with a binder comprising up to 2% by weight of polyvinyl alcohol solids, in aqueous solution, and up to 4%, by weight, of a hardening agent for the polyvinyl alcohol selected from iron oxide, phosphate rock and bauxite or a combination of two or more thereof, and briquetting the coal/binder mixture. The invention also provides briquettes formed using such a process. The polyvinyl alcohol may also be in solution acidified by an acid such as phosphoric or sulphuric acid.

It is to be understood that the term briquetting as used herein includes all methods of forming an agglomerate of coal, including briquetting using conventional ring roll presses, roll presses, die presses and rotary table presses as well as extrusion and pelleting, eg using a disc pelletiser.

The coal may be any bituminous or non-bituminous coal, and the invention is applicable to naturally occurring coals having low smoke emissions such as anthracite, to coals treated, eg by mild oxidation or pyrolysis, to reduce their smoke emissions, to low rank bituminous or non-bituminous coals, and to coal blends including caking or coking coal components and/or coke breeze. Desirably, the coal is of a particle size below 3mm, and anthracite duff is particularly suitable. The coal may be a direct product of coal cutting or may be crushed, or may be recovered from a coal cleaning process.

Suitable polyvinyl alcohol materials are commercially available as powders. Preferably, those products marketed as "medium viscosity" polyvinyl alcohol are used. These are soluble in hot water using 1 part polyvinyl alcohol to 5 to 10 parts of water, by weight.

The inorganic hardening agents are believed to act chemically on the polyvinyl alcohol, so that the briquettes increase in strength on storage in air more rapidly than would be the case if the effect was solely that arising from loss of water. The iron oxide used is preferably ferric oxide, especially in the form of haematite, conveniently used as haematite ore. It is believed that haematite donates oxygen to the polyvinyl alcohol. A particular advantage of the use of haematite is that the ash remaining after combustion of the briquette is of increased density and is more easy to handle. Bauxite, as the ore of aluminum, is also an oxide and is generally found with a proportion of ferric oxide. It will be appreciated that all the hardening agents are available in large quantities and at low cost. These agents may be used along or in combination in total amounts up to 4% by weight. In practice, routine testing is carried out to ensure that any individual briquetting mix is satisfactory.

The admixture of coal and binder may be done at a temperature of from ambient to 100° C. Conventional mixing equipment may be used.

The briquettes may comprise additional components such as wattle bark to improve combustion properties, or to improve strength, eg green strength or strength at combustion temperatures.

The process of the invention preferably includes a self-hardening stage to permit the green briquettes to gain strength. The invention does not require the use of carbonisation or hot curing, and thus significient capital and processing costs may be avoided. The hardening stage may be carried out by cooling and stocking the green briquettes or by maintaining them initially at temperatures up to about 100° C. prior to cooling and stocking. Stocking may be carried out in the open air or under cover. Sensible precautions will avoid unnecessary breakage of briquettes at this stage, and care may be required if the ambient temperatures are below freezing.

The present invention will now be described by way of example only.

EXAMPLE 1

Ninety-four parts by weight of air-dried South Wales anthracite, or nominal size below 3 mm, were mixed with a binder comprising 1 part medium viscosity polyvinyl alcohol to 5 parts water. After heating with live steam to about 100° C. followed by some evaporative cooling air in an open screw conveyor, the mixture was briquetted in a pilot double-roll press at about 80° C. An initial briquette strength of 5 kg was found, which increased during further cooling to 12 kg after one hour and to 16 kg after 24 hours.

EXAMPLE 2

The procedure described in Example 1 was repeated, except that 1% iron ore (haematite) was also incorporarted into the anthracite. An initial briquette strength of 6 kg was found, which increased to 15 kg after one hour, and to 24 kg after 24 hours.

EXAMPLE 3

The procedure described in Example 2 was repeated, except that 0.5% orthophosphoric acid was also incorporated into the binder solution. An initial briquette strength of 7 kg was found, which increased to 20 kg after one hour, and to 38 kg after 24 hours.

EXAMPLE 4

The procedure described in Example 1 was repeated, except that the anthracite was blended with some coking steam coal and 1% phosphate rock was also incorporated into the blend. An initial briquette strength of 5 kg was found, which increased to 24 kg after one hour, and to 41 kg after 24 hours.

The briquettes of examples 1–4 continued to self-harden in air at ambient temperature attaining crushing strengths in the range of 110–140 kg after 7–9 days and 205–260 kg after 21 days. At all stages of hardening the briquettes showed satisfactory resistance to water. However, the hot strength of the briquetes during combustion was not entirely statisfactory.

EXAMPLE 5

An anthracite-based blend of coals including pyrolysed and strongly-caking coal components was admixed 0.5 parts of "Bitan A"—a wattle bark extract—and briquetted with a binder comprising 1 part of medium-viscosity polyvinyl alcohol, 0.25 parts of orthophosphoric acid and 9 parts of water, as outlined in Example 1. The self-hardened briquettes showed an improved thermal stability at combustion temperatures.

We claim:

1. A briquetting process comprising mixing fine coal with a binder comprising up to 2%, by weight of the resulting mixture, of polyvinyl alcohol solids, in aqueous solution, and up to 4%, by weight, of a hardening agent for the polyvinyl alcohol selected from iron oxide, phosphate rock, bauxite or a combination of two or more thereof, and briquetting the coal/binder mixture.

2. A process according to claim 1 wherein the polyvinyl alcohol solution is formed by dissolving 1 part of medium viscosity polyvinyl alcohol in 5 to 10 parts of hot water, by weight.

3. A process according to claim 1 wherein the polyvinyl alcohol solution is acidified with an acid.

4. A process according to claim 1 wherein wattle bark is incorporated in the coal/binder mixture.

5. A process according to claim 1 wherein a strongly caking coal is incorporated in the coal/binder mixture.

6. A process according to claim 1 wherein wattle bark and a strongly-caking coal are incorporated in the coal/binder mixture.

7. A coal briquette comprising a mixture of fine coal and a binder comprising up to 2%, by weight of the mixture, of polyvinyl alcohol solids and up to 4% by weight of a hardening agent for the polyvinyl alcohol, selected from iron oxide, phosphate rock and bauxite or a combination of two or more thereof.

* * * * *